US008753160B2

(12) United States Patent
Ito et al.

(10) Patent No.: US 8,753,160 B2
(45) Date of Patent: Jun. 17, 2014

(54) METHOD FOR FORMING FRONT ELECTRODE OF PDP

(75) Inventors: Kazushige Ito, Kanagawa (JP); Tomonori Ohki, Kanagawa (JP)

(73) Assignee: E. I. du Pont de Nemours and Company, Wilmington, DE (US)

( * ) Notice: Subject to any disclaimer, the term of this patent is extended or adjusted under 35 U.S.C. 154(b) by 128 days.

(21) Appl. No.: 13/351,080

(22) Filed: Jan. 16, 2012

(65) Prior Publication Data

US 2013/0076225 A1 Mar. 28, 2013

Related U.S. Application Data

(60) Provisional application No. 61/432,757, filed on Jan. 14, 2011.

(51) Int. Cl.
*H01J 9/02* (2006.01)

(52) U.S. Cl.
USPC ..... 445/35; 313/582

(58) Field of Classification Search
CPC ..... H01J 9/022; H01J 11/12; H01J 11/24; H01J 1/30
USPC ..... 445/24, 25, 35; 313/582–587
See application file for complete search history.

(56) References Cited

U.S. PATENT DOCUMENTS

| | | | | |
|---|---|---|---|---|
| 3,380,381 | A | 4/1968 | Musgrave | |
| 5,032,490 | A | 7/1991 | Nebe et al. | |
| 5,851,732 | A * | 12/1998 | Kanda et al. | 430/321 |
| 7,052,824 | B2 | 5/2006 | Keusseyan | |
| 2004/0234886 | A1 | 11/2004 | Rudolph et al. | |
| 2006/0266984 | A1 * | 11/2006 | Lee et al. | 252/500 |
| 2009/0039781 | A1 * | 2/2009 | Ito et al. | 313/582 |

FOREIGN PATENT DOCUMENTS

| | | | |
|---|---|---|---|
| JP | 2003208846 | A | 7/2003 |
| JP | 2003234063 | A | 8/2003 |
| JP | 2006120568 | A | 5/2006 |

* cited by examiner

*Primary Examiner* — Anh Mai
*Assistant Examiner* — Andrew Coughlin

(57) ABSTRACT

A method is disclosed for forming a PDP front electrode by applying a particular type of photopolymerizable black paste, drying the black paste, and applying a particular type of photopolymerizable white paste on top of the dried black paste.

6 Claims, 2 Drawing Sheets

METHOD FOR FORMING FRONT ELECTRODE OF PDP

FIELD OF THE INVENTION

This invention relates to a method for forming a front electrode for a plasma display panel.

BACKGROUND OF THE INVENTION

Recently, the electrodes used in the front panels of plasma display panels (PDPs) are being required to have finer and finer lines. To form fine lines, photosensitive conductive pastes are conventionally used to form PDP electrodes. However, the problem has been that during light exposure, not enough light energy may reach the base of the photosensitive paste applied to the substrate, and the pattern may therefore have an inverted trapezoidal cross-section after development, which is a phenomenon sometimes called "undercut". If the undercut is great, the intended pattern may peel off the substrate during the development process. The following is an example of prior art aimed at addressing the issue of how to control undercut in PDP.

JP 2006-120568 discloses a PDP front electrode formed using a black photosensitive paste containing about 16 parts by weight of a photopolymerizable monomer and 60 parts by weight of tricobalt tetraoxide with a specific surface area of 8.2 $m^2/g$, and a white photosensitive paste with about 6 parts by weight of a photopolymerizable monomer added thereto.

SUMMARY OF THE INVENTION

Figure 1:
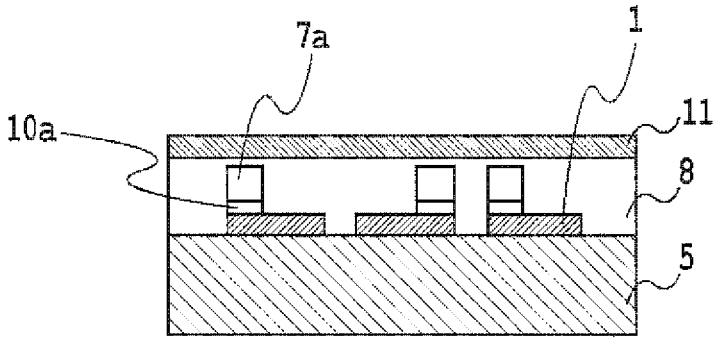
FIG. 1 is a schematic diagram illustrating a structure of a front panel of AC PDP.

An object of the present invention is to provide a method for forming a front electrode of PDP with a fine electrode.

An aspect of the invention relates to a method for forming a front electrode of PDP, comprising steps of: applying, to a substrate, a black paste comprising a photopolymerizable monomer and first inorganic powders comprising glass powder, black pigment and optionally conductive metal powder, wherein $S_b/M_b$ is 18 or less when $S_b$ represents the total surface area ($m^2$) of the first inorganic powder per 100 g of the black paste and $M_b$ represents the content (g) of the photopolymerizable monomer per 100 g of the black paste; drying the black paste; applying a white paste comprising a photopolymerizable monomer and second inorganic powders comprising glass powder and conductive metal powder on top of the dried black paste, wherein $S_w/M_w$ is 4.5 or less when $S_w$ represents the total surface area ($m^2$) of the second inorganic powder per 100 g of the white paste and $M_w$ represents the content (g) of the photopolymerizable monomer per 100 g of the white paste; drying the white paste; exposing and developing the dried black paste and the dried white paste; and sintering the developed black paste and white paste.

A fine PDP electrode can be formed by a good balance of components and compounded amounts thereof in order to obtain fine lines while controlling undercut.

DETAILED DESCRIPTION OF THE INVENTION

An embodiment relates to a method for forming a front electrode on a PDP front panel. A front electrode comprises a white electrode and a black electrode. And a white electrode and a black electrode are formed with a black paste and a white paste. The black paste and the white paste and the method for forming the front electrode using them are described below.

1. Black Paste

Black electrode of PDP front electrode takes an inherent function of improving a display panel contrast. Black electrode is formed with a black paste. The materials in the black paste are respectively described below. In the present application, "Black" can also be represented by an L value, but black means that the L value is relatively low among a front electrode. The term "black paste", "black paste layer" and "black electrode" in the present application relates to an under-layer black electrode that provides contrast within a front electrode.

The black paste comprises the first inorganic powder which contains (A) glass powder, (B) black pigment powder and optionally, (C) conductive metal powder; and organic constituents which contains (D) organic medium, (E) photopolymerization initiator and (F) photo-polymerizable monomer.

The components are explained in detail below.

(A) Glass Powder

The basic function of the glass powder is to promote sintering of conductive component particles and also to bind the electrode to a substrate.

The specific surface area (SA) of the glass powder is at least 0.5 $m^2/g$ in an embodiment, or at least 1.0 $m^2/g$ in another embodiment. This is because it is easy to control line error and form fine patterns if the specific surface area is 0.5 $m^2/g$ or more. The specific surface area of the glass powder is 5.0 $m^2/g$ or less in an embodiment, and 3.0 $m^2/g$ or less in another embodiment. This is because it is easier to disperse the glass in an organic binder to form a paste if the specific surface area is 5.0 $m^2/g$ or less. The specific surface area is the surface area per unit weight.

(Method for Measuring Specific Surface Area)

Surface area could be measured by BET method. BET method is determined according to the method of Brunauer, Emmett, and Teller. By this method, the volume of nitrogen gas is measured, which is adsorbed on the surface of the adsorbing material at −196° C. dependent upon the applied pressure. This method is well known to those skilled in the art. BET method could be referred to US2004234886, too.

When the specific surface area is as described above, and if the glass powder is spherical, the D50 (the point at which ½ of the particles are smaller than and ½ are larger than the specified size) will be about 0.4 to 2.0 μm as measured with a laser scattering-type particle size analyzer (MT3100II, Microtrac Co., Ltd.).

The glass powder is 15 g or more in an embodiment, and 20 g or more in another embodiment, per 100 g of the black paste. When the glass powder is 15 g or more per 100 g of the black paste, sufficient bind of the other first inorganic powder can be expected. Per 100 g of the black paste, the glass powder is preferably 50 g or less, more preferably 40 g or less. When the glass powder content is 50 g or less per 100 g of the black paste, bonding to a substrate can be sufficient.

The softening point of the glass powder is normally to be 325 to 700° C., 350 to 650° C. in an embodiment. If melting takes place at a temperature lower than 325° C., the organic components might tend to become enveloped, and subsequent degradation of the organic components might cause blisters to be produced in the paste. A softening point over 700° C., on the other hand, might weaken the paste adhesion and may damage the glass substrate.

Types of glass powder, but not limited, may include bismuth-based glass powder, boric acid-based glass powder, phosphorus-based glass powder, zinc-boron based glass powder and lead-based glass powder. The use of lead-free glass powder is preferred in consideration of the burden imposed on the environment.

Glass powder can be prepared by methods well known in the art. For example, the glass component can be prepared by mixing and melting raw materials such as oxides, hydroxides, carbonates etc, and making into a cullet by quenching, followed by mechanical pulverization (wet or dry milling). Commercial glass powder can also be used.

(B) Black Pigment Powder

Black pigment powder is used to ensure the blackness of the black front electrode. Examples of black pigment powder include $Co_3O_4$, chromium-copper-cobalt oxides, chromium-copper-manganese oxides, chromium-iron-cobalt oxides, ruthenium oxides, ruthenium pyrochlore, lanthanum oxides (ex. $La_{1-x}Sr_xCoO_3$), manganese cobalt oxides, and vanadium oxides (ex. $V_2O_3$, $V_2O_4$, $V_2O_5$). $Co_3O_4$ (tricobalt tetroxide) is preferred in consideration of the burden imposed on the environment, material costs, the degree of blackness, and the electrical properties of the black electrode.

The specific surface area of the black pigment powder is at least 3.0 $m^2/g$ or more in an embodiment, and at least 5.0 $m^2/g$ in another embodiment. Fine lines are easier to form if it is at least 3.0 $m^2/g$. The specific surface area of the black pigment powder is 15 $m^2/g$ or less in an embodiment, and 8.0 $m^2/g$ or less in another embodiment. It is easier to disperse the powder in an organic binder to form a paste if the specific surface area is 15 $m^2/g$ or less. The specific surface area of the black pigment powder is measured by the same BET method used to measure the specific surface area of the glass powder.

When the specific surface area is as described above, and if the black pigment powder is spherical for example, the particle size (D50) could be about 0.4 to 1.8 μm as measured with a laser scattering-type particle size analyzer (MT3100II, Microtrac Co., Ltd.).

The black pigment powder is 6 g or more in an embodiment, and 9 g or more in another embodiment per 100 g of the black paste. 6 g or more per 100 g of the black paste will provide sufficient black color to the PDP. Moreover, black pigment powder is 20 g or less in an embodiment, and 16 g or less in another embodiment per 100 g of the black paste. 20 g or less per 100 g of the black paste, it will be easier to form a fine electrode for reasons involving the content of the monomer.

(C) Conductive Metal Powder

A conductive metal powder may be optionally added to the black paste to ensure that a black electrode is conductive with the white paste layer and transparent electrode in case of transparent electrode is formed. Because the black pigment powder described in section (B) is conductive to a certain extent, the content of the conductive metal powder in the black paste will depend on the black pigment powder conductivity or amount added. For example, when a black pigment powder having a certain degree of conductivity such as ruthenium oxide or ruthenium pyrochlore is used, no conductive power might need to be added. If added, conductive metal powder includes, but is not limited to, gold (Au), silver (Ag), platinum (Pt), palladium (Pd), copper (Cu), aluminum (Al), nickel (Ni), tungsten (W), a combination thereof or an alloy thereof. In terms of conductivity, the conductive metal powder is preferably Au, Pt, Ag, Pd, a combination thereof or an alloy thereof. In terms of cost and effect, the conductive metal powder is preferably Cu, Ni, Al, W, a combination thereof or an alloy thereof. In terms of both of conductivity and cost, the conductive metal powder is preferably Ag. The alloy includes, but not limited to, Ag—Pd alloy, Ag—Pt alloy, Ag—Pt—Pd alloy, Pt—Pd alloy. In terms of cost and effect, the alloy is preferably Ag—Pd alloy, Ag—Pt—Pd alloy or Pt—Pd alloy, and more preferably Ag—Pd alloy.

Virtually any shape conductive metal powder, including spherical particles, may be used in the black paste. The shape is a spherical shape in an embodiment because spherical powders have relatively better filling ratio and UV permeability than other shapes.

The specific surface area of the conductive metal powder is at least 0.1 $m^2/g$ in an embodiment, and at least 0.3 $m^2/g$ in another embodiment. Fine lines are easier to form if the specific surface area is at least 0.1 $m^2/g$. The specific surface area of the conductive metal powder is 5.0 $m^2/g$ or less in an embodiment, and 3.0 $m^2/g$ or less in another embodiment. The powder will be more easily dispersed in an organic binder to form a paste if the specific surface area is 5.0 $m^2/g$ or less.

The specific surface area of the conductive metal powder is measured by the same BET method used to measure the specific surface area of the glass powder.

When the specific surface area is as described above, the average particle diameter (D50) could be in the range of 0.1 to 5.0 μm in the case of a spherical conductive metal powder for example.

The content of the conductive metal powder is 0.01 to 3.0 g in an embodiment, and 0.1 to 1.0 g in another embodiment per 100 g of the black paste. Even when a conductive metal powder is added to the black paste, it has little effect on the total surface area of the inorganic components in the paste because the added amount is small. In addition, when a PDP front panel has no transparent electrode, that is, when the black paste layer is formed directly on the glass substrate, there will be no need to include a conductive metal powder in the black paste.

(Total Surface Area of First Inorganic Powders Per 100 g of the Black Paste)

The total surface area of the first inorganic powder per 100 g of the black paste is the sum of the surface areas of each of the first inorganic powder contained in 100 g of the black paste, that is, at least (A) glass powder and (B) black pigment powder, and optionally (C) conductive metal powder. The total surface area of the first inorganic powder per 100 g of the black paste is 50 $m^2$ or more in an embodiment. If the total surface area of the first inorganic powder is 50 $m^2$ or more, an electrode with a smooth surface and excellent appearance can be formed because the inorganic powders could have a suitable particle diameter, although this is also affected by the shapes of the inorganic powders. The total surface area of the first inorganic powder per 100 g of the black paste is at least 65 $m^2$ in an embodiment, and at least 85 $m^2$ in an embodiment. Moreover, the total surface area of the first inorganic powder per 100 g of the black paste is 200 $m^2$ or less. If the total surface area of the inorganic powders is too large, the powder particles could be small, and may be difficult to disperse uniformly in the paste. The total surface area of the first inorganic powder per 100 g of the black paste is 180 $m^2$ or less in an embodiment, and 170 $m^2$ or less in another embodiment.

The total surface area of the first inorganic powder per 100 g of the black paste can be determined by the following formula when the first inorganic powder in the black paste are glass powder, black pigment and conductive metal powder. The weights (g) of the components in the formula are the values per 100 g of the black paste.

Total surface area($m^2$)of the first inorganic powder per 100 g of the black paste=weight(g)of glass powder×SA($m^2$/g)of glass powder+weight(g)of black pigment powder×SA($m^2$/g)of black pigment powder+weigh(g)of conductive metal powder×SA($m^2$/g)of conductive metal powder.

(D) Organic Medium

An organic medium is used in the black paste to allow the first inorganic powder such as glass powder and black pigment to be dispersed in the black paste composition. The organic medium is however burned off during firing process.

The development in an aqueous system is preferred to be taken into consideration in selecting the organic binder. One with high resolution is preferred to be selected. The organic medium contains acrylic polymer in an embodiment.

The molecular weight of the organic binder is not particularly limited, but is less than 50,000 in an embodiment, less than 25,000 in another embodiment, and less than 15,000 in another embodiment. When the conductive composition is applied by screen printing, the Tg (glass transition temperature) of the organic binder preferably exceeds 90° C. When the electrode paste is dried normally at a temperature of 90° C. or less after screen printing, the paste could become viscous if the Tg value is at or below this temperature. One with a lower Tg value can be adopted for a black paste to be applied by a method other than screen printing.

The organic medium may optionally contain organic solvent to adjust viscosity of the black paste. In an embodiment, the one which the organic polymer and other organic components can be completely dissolved in are used. For example, turpentine, terpine, ethylene glycol monobutyl ether, butyl carbitol, butyl carbitol acetate or Texanol (2,2,4-trimethyl-1,3-pentanediol monoisobutyrate) can be used as a organic solvent.

The amount of organic medium can be adjusted in conjunction with the amount of photopolymerizable monomer. The organic medium is 19 to 40 g per 100 g of the black paste in an embodiment. And the total content of organic medium and photopolymerizable monomer is 25 to 65 g per 100 g of the black paste in an embodiment.

(E) Photo-polymerization Initiator

In general, photopolymerization initiators produce either radicals, cations (acids) or anions (bases) when exposed to ultraviolet or electron beams. The photopolymerization initiator is of the type that produces radicals when exposed to ultraviolet or electron beams or the like, especially at wavelengths of 200 to 400 nm. The role of the photopolymerization initiator is to generate free radicals by means of optical energy, promoting polymerization of the photopolymerizable monomer. The type of photopolymerization initiator is not particularly limited. However, desirable photoinitiator could be thermally inactive but produce free radicals when exposed to actinic rays at a temperature of 185° C. or below. Examples include compounds having two intramolecular rings in a conjugated carbocyclic system. More specific examples of desirable photoinitiators include 9,10-anthraquinone, 2-methyl anthraquinone, 2-ethyl anthraquinone, 2-t-butyl anthraquinone, octamethyl anthraquinone, 1,4-naphthoquinone, 9,10-phenanthrenequinone, 2-methyl-1-(4-methyl thiophenyl-2-morpho-lino-propanones, benzo[a]anthracene-7,12-dione, 2,3-naphthacene-5,12-dione, 2-methyl-1,4-naphthoquinone, 1,4-dimethyl anthraquinone, 2,3-dimethyl anthraquinone, 2-phenyl anthraquinone, 2,3-diphenyl anthraquinone, retenquinone, 7,8,9,10-tetrahydronaphthacene-5,12-dione, and 1,2,3,4-tetrahydrobenzo[a]anthracene-7,12-dione.

(F) Photo-polymerizable Monomer

Photopolymerizable monomer is a monomer, dimer or trimer having an ethylenic unsaturated bond. The role of this photopolymerizable monomer is to form polyethylene chains by polymerizing with other monomers using free radicals generated by the reaction of the initiator to optical energy. The type of photopolymerizable monomer is not particularly limited, but a monomer with good reactivity is desirable for forming fine patterns. Examples include ethylenic unsaturated compounds having at least one polymerizable ethylene group. Such compounds can initiate polymer formation through the presence of free radicals, bringing about chain extension and addition polymerization. The monomer compounds are non-gaseous; that is, they have a boiling point higher than 100° C. and have the effect of making the organic binder plastic. Desirable monomers that can be used alone or in combination with other monomers include t-butyl (meth) acrylate, 1,5-pentanediole di(meth)acrylate, N,N-dimethylaminoethyl (meth)acrylate, ethylene glycol di(meth)acrylate, 1,4-butanediol di(meth)acrylate, diethylene glycol di(meth)acrylate, hexamethylene glycol di(meth)acrylate, 1,3-propanediol di(meth)acrylate, decamethylene glycol di(meth)acrylate, 1,4-cyclohexanediol di(meth)acrylate, 2,2-dimethylol propane di(meth)acrylate, glycerol di(meth)acrylate, tripropylene glycol di(meth)acrylate, glycerol tri(meth) acrylate, trimethylol propane tri(meth)acrylate, the compounds given in U.S. Pat. No. 3,380,381, the compounds disclosed in U.S. Pat. No. 5,032,490, 2,2-di(p-hydroxyphenyl)-propane di(meth)acrylate, pentaerythritol tetra(meth) acrylate, triethylene glycol diacrylate, polyoxyethyl-1,2-di-(p-hydroxyethyl)propane dimethacrylate, bisphenol A di-[3-(meth)acryloxy-2-hydroxypropyl)ether, bisphenol A di-[2-(meth)acryloxyethyl)ether, 1,4-butanediol di-(3-methacryloxy-2-hydroxypropyl)ether, triethylene glycol dimethacrylate, polyoxypropyl trimethylol propane triacrylate, trimethylol propane ethoxy triacrylate, butylene glycol di(meth)acrylate, 1,2,4-butanediol tri(meth)acrylate, 2,2,4-trimethyl-1,3-pentanediol di(meth)acrylate, 1-phenylethylene-1,2-dimethacrylate, diallyl fumarate, styrene, 1,4-benzenediol dimethacrylate, 1,4-diisopropenyl benzene, 1,3,5-triisopropenyl benzene, monohydroxypolycaprolactone monoacrylate, polyethylene glycol diacrylate, dipentaerythritol pentaacrylate, ethoxytriacrylated trimethylolprpane triacrylate and polyether acrylate and polyethylene glycol dimethacrylate. Here, "(meth)acrylate" is an abbreviation indicating both acrylate and methacrylate. The above monomers could undergo modification such as polyoxyethylation or ethylation. In an embodiment, dipentaerythritol pentaacrylate, ethoxytriacrylated and trimethylolprpane triacrylate and Polyether acrylate mixed together in equal amounts can also be used.

The content of the photopolymerizable monomer is 6.0 g or more per 100 g of the black paste in an embodiment. If the content of the photopolymerizable monomer is 6 g or more per 100 g of the black paste, it could be possible to control undercut and form fine patterns. From the standpoint of fine line formation, the content of the photopolymerizable monomer is at least 9 g or more in an embodiment, and at least 10 g or more in another embodiment per 100 g of the black paste. The content of the photopolymerizable monomer is 30.0 g or less per 100 g of the black paste in an embodiment. By keeping the content of the photopolymerizable monomer at 30.0 g or less per 100 g of the black paste, it is possible to reduce the amount of organic residue in the electrode that is not burned out during firing. From the standpoint of organic residue, the content of the photopolymerizable monomer in the black paste is preferably 28.0 g or less per 100 g of the black paste. 25.0 g or less per 100 g of the black paste is still more preferable.

Besides the components described above, the black paste may also include well-known additional components such as dispersants, stabilizers, plasticizers, stripping agents, surfactants, defoamers, and wetting agents as an additive.

(Total Surface Area of First Inorganic Powders Per 100 g of Black Paste/Content of Photopolymerizable Monomer ($S_b/M_b$))

In an embodiment, the following relationship exists between the total surface area of the first inorganic powder per 100 g of the black paste and the content of the photopolymerizable monomer. When $S_b$ represents the total surface area of the first inorganic powder per 100 g of the black paste and $M_b$ represents the content of the photopolymerizable monomer, $S_b/M_b$ is 18 or less. As shown in the examples, fine lines can be formed if $S_b/M_b$ is 18 or less. From the standpoint of fine line formation, the $S_b/M_b$ of the black paste is 15 or less in an embodiment, 10 or less in another embodiment, and 7 or less in another embodiment.

(Significance of $S_b/M_b$ as a Benchmark)

The mechanism of polymerization of the photopolymerizable monomer is as follows. Radicals (free groups) are produced by the polymerization initiator in response to light irradiation (exposure), and the photopolymerizable monomer is continuously polymerized by these radicals. However, the photosensitive conductive paste contains conductive powder, glass powder, black pigment and other inorganic powders, and these inorganic powders can reflect, diffuse or absorb the irradiated light, so that the light does not reach the bottom of the paste. After continuous polymerization has been initiated by the generated radicals, moreover, it can be arrested by collisions between the monomer and the inorganic powder. Such light interference or interference with continuous polymerization of the monomer can be controlled by adjusting the total surface area of the inorganic powders. That is, it is thought that if the total surface area of the inorganic powders contained in the photosensitive conductive paste is small, reflection, diffusion and absorption of irradiated light can be controlled, as can collisions by the monomer after the start of polymerization, making it easier to cure the paste as a whole. If the total surface area of the inorganic powders contained in the photosensitive conductive paste is large, on the other hand, diffusion and the like of irradiated light and collisions by the monomer after the start of polymerization are more likely, so that the paste as a whole may not cure properly, and the bottom surface opposite the light-receiving surface of the electrode in particular may not cure properly, resulting in the problem of so-called undercut.

The monomer content and the total surface area of the inorganic powders in the photosensitive conductive pastes are focused, and used these ratios as new benchmarks. By adjusting these ratios within specific ranges, it is possible to control undercut, making such adjustment an effective tool for fine line formation.

2. White Paste

The white paste contains the second inorganic powder which contains (G) glass powder, (H) conductive metal powder; and organic constituents which contains (I) organic medium, (J) photo-polymerization initiator and (K) photopolymerizable monomer. The components are described below. In addition, "white paste or white electrode" in the present application relates to the upper layer of an front electrode to enhance the conductivity within a front electrode. Furthermore, "white" does not mean white reflecting all light, but means relatively white in relation to the black paste and black layer described above. The white layer generally includes silver as a conductive metal powder, and is often perceived as white in terms of color vision because it is formed on the black layer.

(G) Glass Powder

The basic function of the glass powder used in a white paste is to promote sintering of conductive component particles. The composition and principal properties of glass powders that can be used in the white paste are same to those explained above for the (A) glass powder of the black paste. However, the glass powder in white paste differs in the following respects from the glass powder in the black paste described above.

The glass powder is 0.4 g or more in an embodiment, and 0.8 g or more in an embodiment, per 100 g of the white paste. When the glass powder content is 0.4 g or more per 100 g of the white paste, bonding to a substrate can be sufficient. Per 100 g of the white paste, the glass powder is 5.0 g or less in an embodiment, and 3.0 g or less in another embodiment per 100 g of the white paste. When the glass powder is 5.0 g or less per 100 g of the white paste, sintering inorganic components might be sufficiently bound.

(H) Conductive Metal Powder

The white paste contains conductive metal powder. Conductive metal powder in the white paste gives sufficient conductivity to a front electrode. The types and shapes of conductive metal powders that can be used in the white paste are same to those explained above for the (C) conductive metal powder of the black paste. However, the content of the conductive metal powder is different than in the black paste. Conductive metal powder is 40 to 80 g in an embodiment, 48 to 75 g in another embodiment, and 55 to 70 g in another embodiment per 100 g of the white paste. If there is too little conductive metal powder, the conductivity will be insufficient. If there is too much conductive metal powder, on the other hand, photosensitivity may decline for reasons associated with the photopolymerizable monomer.

The specific surface area of the conductive metal powder in the white paste is at least 0.1 $m^2/g$ in an embodiment, and at least 0.3 $m^2/g$ in another embodiment. If the specific surface area is too small, it may become difficult to form fine lines. The specific surface area of the conductive metal powder is 2.0 $m^2/g$ or less in an embodiment, and 1.0 $m^2/g$ or less in another embodiment. If the specific surface area is too large, the powder may be difficult to disperse in the organic binder, making it difficult to form a paste.

The specific surface area of the conductive metal powder in the white paste is measured by the same BET method used to measure the specific surface area of the glass powder in the black paste.

When the specific surface area is as described above, the average particle diameter (PSD D50) ranges from 0.5 to 3.0 μm in the case of a spherical conductive metal powder for example.

The conductive metal powder is 0.01 to 3.0 g in an embodiment, and 0.1 to 1.0 g in an embodiment per 100 g of the black paste.

(Total Surface Area of the Second Inorganic Powder Per 100 g of the White Paste)

The total surface area of the second inorganic powder per 100 g of the white paste is the sum of the surface area of the second inorganic powder, that is, at least (G) glass powder and (H) conductive metal powder contained in 100 g of the white paste. The total surface area of the second inorganic powder per 100 g of the white paste is 60 $m^2$ or less in an embodiment, 55 $m^2$ or less in another embodiment, and 50 $m^2$ or less in another embodiment. The second inorganic powder could be easier to disperse uniformly in the paste if the total surface area is 60 $m^2$ or less. The total surface area of the second inorganic powder per 100 g of the white paste is at least 4.5 $m^2$ in an embodiment, at least 6 $m^2$ in another embodiment, and at least 8 $m^2$ in another embodiment.

The total surface area of the second inorganic powder per 100 g of the white paste can be determined by the following formula when the second inorganic powder in the white paste are glass powder and conductive metal powder. In the following formula, the weight (g) represents weight per 100 g of the white paste.

Total surface area of the second inorganic powders per 100 g of the white paste($m^2$)=weight(g)of glass powder×SA($m^2$/g)of glass powder+weight(g)of conductive metal powder×SA($m^2$/g)of conductive metal powder (I) Organic Medium The same organic medium explained above for the black paste can be used as the organic medium for the white paste.

(J) Photo-polymerization Initiator

The same photopolymerization initiator explained above for the black paste can be used for the white paste, including the content thereof in the white paste.

(K) Photo-polymerizable Monomer

The photopolymerizable monomer used in the white paste is not particular limited, but could be of the same kind used in the black paste above. The photopolymerizable monomer in the white paste is at least 4.0 g per 100 g of the white paste in an embodiment. If the photopolymerizable monomer is at least 4.0 g per 100 g of the white paste, photocuring could be satisfactory, and it will be easy to form a fine pattern. The photopolymerizable monomer in the white paste is at least 4.8 g in an embodiment, and at least 5.5 g in another embodiment per 100 g of the white paste. The photopolymerizable monomer is 20.0 g or less per 100 g of the white paste. Residue after firing is controlled if the content is 20.0 g or less. The photopolymerizable monomer in the white paste is 18.0 g or less in an embodiment, and 16.0 g or less in another embodiment, per 100 g of the white paste.

Besides the components described above, the white paste may also include well-known additional components such as dispersants, stabilizers, plasticizers, stripping agents, surfactants, defoamers, and wetting agents as an additive.

(Total Surface Area of Second Inorganic Powders Per 100 g of the White Paste/Content of Photopolymerizable Monomer ($S_w/M_w$))

The following relationship exists between the total surface area ($m^2$) of the second inorganic powder per 100 g of the white paste and the content (g) of photopolymerizable monomer per 100 g of the white paste. When $S_w$ represents the total surface area of the second inorganic powder and $M_w$ represents the content of the photopolymerizable monomer, $S_w/M_w$ is 4.5 or less. If $S_w/M_w$ is 4.5 or less, a fine line can be formed as shown in the examples described below. The $S_w/M_w$ of the white paste is 4.0 or less in an embodiment, 3.0 or less in another embodiment, and 1.7 or less in another embodiment.

3. Method for Forming a Front Electrode

An aspect of the present invention relates to method for forming a front electrode of PDP using the aforementioned black paste and the aforementioned white paste. A method for producing a front electrode is described below with reference to FIGS. 1 and 2.

FIG. 1 illustrates the structure of a front panel of AC PDP. As illustrated in FIG. 1, a front panel of the PDP has the following structural elements: glass substrate 5, transparent electrodes 1 formed on the glass substrate 5, black electrode 10*a* formed on the transparent electrodes 1, and white electrode 7*a* formed on the black electrode 10*a*. A dielectric coating layer (transparent overglaze layer) (TOG) 8 and an MgO coating layer 11 are generally formed on the white electrode 7*a*. In recent development, however, attempts have been made to omit transparent electrodes in the interest of reducing costs.

Figure 2:
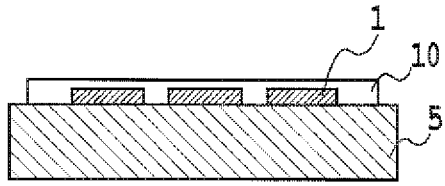
FIG. 2 is a schematic diagram illustrating a method a method for forming a front electrode.
Figure 2:
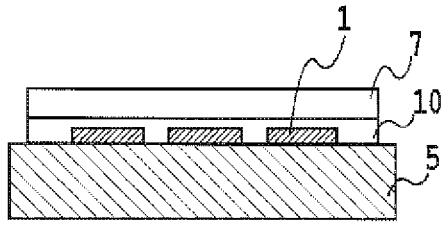
Figure 2:
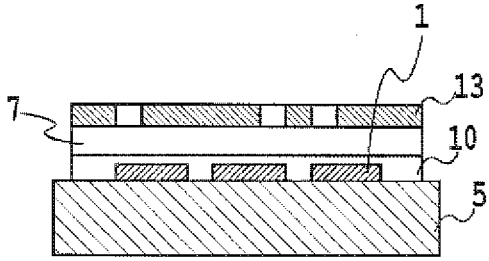
Figure 2:
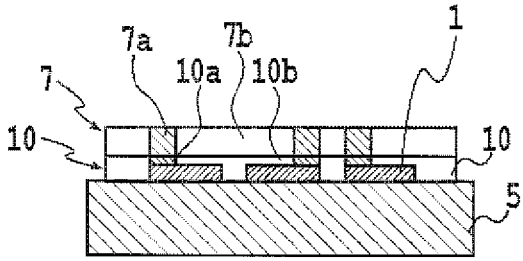
Figure 2:
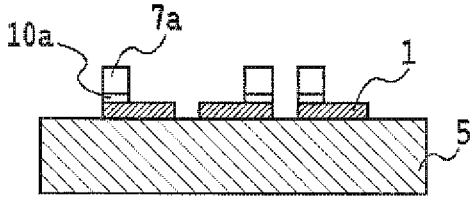

A method for forming the front electrodes on the front panel of the PDP is described in detail below. As illustrated in FIG. 2, a method for forming a front electrode contains a series of processes (FIG. 2(A) through (E)). The transparent electrodes 1 are formed on a glass substrate 5 in accordance with conventional methods known to those having ordinary skill in the art. For example, the transparent electrodes 1 are usually formed with $SnO_2$ or ITO. They can be formed by ion sputtering, ion plating, chemical vapor deposition, or an electrode position technique. Such transparent electrode structures and forming methods are well known in the field of AC PDP technology. As aforementioned, the transparent electrode 1 is, however, sometimes omitted in the recent development in cost reduction point of view. The present invention could be used for such the transparent electrode less PDP. In case of the transparent electrode less PDP, a black paste would be applied onto directly onto a glass substrate 5 of a PDP front panel.

The black paste described above is applied onto transparent electrode 1 formed on a glass substrate 5 to form a black paste layer 10, and the black paste layer 10 is then dried, typically in nitrogen or the air (FIG. 2(A)). The black paste can be applied by a conventional method such as a screen printing method, dispenser method, film transfer method or the like. Japanese Patent Application Laid-open No. 2003-208846 or 2003-234063 can be consulted with respect to dispenser methods. U.S. Pat. No. 7,052,824 can be consulted with respect to photosensitive film transfer methods.

A white paste for forming the white paste layer 7 is then applied onto the black paste layer 10. The white paste layer 7 is then dried, typically in nitrogen or the air (FIG. 2(B)). The white paste can be applied by a conventional method as well as the black paste.

The black paste layer 10 and white paste layer 7 are exposed to light under a condition ensuring the formation of a proper electrode pattern after development. During the exposure to light, the material is usually exposed to UV rays through a photo mask 13 having a configuration corresponding to a pattern of electrode (FIG. 2(C)).

The black paste layer 10 and the white paste layer 7 are developed in a basic aqueous solution such as 0.4 g sodium carbonate aqueous solutions or another alkaline aqueous solution. In this developing process, the parts (10*b* and 7*b*) of the layers 10 and 7 that have not been exposed to light are removed by the aqueous solution. The parts (10*a* and 7*a*) that have been exposed to light remain (FIG. 2(D), and FIG. 2(E)). The patterns after development are then formed.

The patterns that have been formed are sintered, typically at between 450 and 650° C. for two hours. The sintering temperature is selected according to material of the conductive metal paste. At this stage, the glass powder melts and becomes firmly attached to the substrate. As noted above, the reason is to ensure vertical conduction in PDP black paste layer.

With this manufacturing method of the present invention using a black paste and a white paste, it is possible to form a fine electrode for a PDP front panel with little undercut.

EXAMPLES

The invention is illustrated in further detail below by examples. The examples are for illustrative purposes only, and are not intended to limit the scope of the invention.

1. Preparation of Organic Medium

Texanol® as an organic solvent and acrylic polymer having a molecular weight of 6,000 to 7,000 were mixed. Mixing ratio of the solvent and the acrylic polymer was 2:1 by weight. And then the organic medium was stirred until all of the acrylic polymer had dissolved.

2. Preparation of Black Paste

Photopolymerizable monomer, photo-polymerization initiator, additive and inorganic component of $B_2O_3$—$SiO_2$—$Al_2O_3$ base glass powder, cobalt oxide powder as a black pigment and Ag/Pd alloy powder as a conductive metal were added to the organic medium. Photopolymerizable monomer was a mixture of Dipentaerythritol pentaacrylate, Ethoxytriacrylated trimethylolprpane triacrylate and polyether acrylate with the mixing ratio of 1:1 by weight. Content of the photopolymerizable monomer is shown in Table 3. 2-methyl-1-4-methylthiophenyl-2-morpho-lino-propanones as a photo-initiator were used with amount of 1.5 g per 100 g of black paste. The additive was a stabilizer with amount of 0.6 g per 100 g of the black paste. Content and surface area (SA) of glass powder, black pigment powder and conductive metal powder per 100 g of black paste were shown in Table 1 as well as total surface area (TSA) of the first inorganic powder. The TSA of the black paste is the total surface area of the first inorganic powder contained per 100 g of the black paste. The TSA of the black paste is the sum of the weights (g) of the glass powder, black pigment powder and conductive metal powder per 100 g of the black paste multiplied by the SA values ($m^2/g$) of each.

The mixture was mixed well until the particles of the inorganic materials were wet with the organic medium. Then the mixture was dispersed using a 3-roll mill. The resulting black paste was filtered through a 20 μm square mesh filter.

The viscosity of the black paste at this point in time was about 15 Pascal second as measured, for example, at 10 rpm and 25° C.

TABLE 1

| Black paste | | | | | | | |
|---|---|---|---|---|---|---|---|
| | Black pigment | | Glass powder | | Ag/Pd alloy powder | | TSA |
| | SA ($m^2/g$) | weight (g) | SA ($m^2/g$) | weight (g) | SA ($m^2/g$) | weight (g) | ($S_b$) ($m^2$) |
| Example 1-1 | 5 | 15 | 3.5 | 26.0 | 0.4 | 0.1 | 165 |
| Example 1-2 | 5 | 15 | 1.9 | 26.0 | 0.4 | 0.1 | 124 |
| Example 1-3 | 5 | 15 | 0.6 | 26.0 | 0.4 | 0.1 | 90 |
| Example 2-1 | 5 | 12 | 4.0 | 26.0 | 0.4 | 0.1 | 165 |
| Example 2-2 | 5 | 12 | 2.5 | 26.0 | 0.4 | 0.1 | 124 |
| Example 2-2 | 5 | 12 | 1.2 | 26.0 | 0.4 | 0.1 | 90 |
| Example 3-1 | 5 | 10 | 4.4 | 26.0 | 0.4 | 0.1 | 165 |
| Example 3-2 | 5 | 10 | 2.8 | 26.0 | 0.4 | 0.1 | 124 |
| Example 3-3 | 5 | 10 | 1.5 | 26.0 | 0.4 | 0.1 | 90 |
| Example 4-1 | 10 | 12 | 2.2 | 20.0 | 0.4 | 0.1 | 165 |
| Example 4-2 | 10 | 12 | 0.2 | 20.0 | 0.4 | 0.1 | 124 |
| Example 4-3 | 8 | 10 | 0.5 | 20.0 | 0.4 | 0.1 | 90 |
| Example 5-1 | 8 | 10 | 3.3 | 26.0 | 0.4 | 0.1 | 165 |
| Example 5-2 | 8 | 10 | 1.7 | 26.0 | 0.4 | 0.1 | 124 |
| Example 5-3 | 8 | 10 | 0.4 | 26.0 | 0.4 | 0.1 | 90 |
| Example 6-1 | 3 | 15 | 6.0 | 20.0 | 0.4 | 0.1 | 165 |
| Example 6-2 | 3 | 15 | 3.9 | 20.0 | 0.4 | 0.1 | 124 |
| Example 6-3 | 3 | 15 | 2.2 | 20.0 | 0.4 | 0.1 | 90 |
| Example 7-1 | 3 | 18 | 3.5 | 30.0 | 0.4 | 0.1 | 160 |
| Example 7-2 | 3 | 18 | 2.3 | 30.0 | 0.4 | 0.1 | 124 |
| Example 7-3 | 3 | 18 | 1.2 | 30.0 | 0.4 | 0.1 | 90 |
| Comparative example 1-1 | 12 | 18 | 1.7 | 20.0 | 0.4 | 0.1 | 250 |
| Comparative example 1-2 | 5 | 18 | 6.7 | 15.0 | 0.4 | 0.1 | 190 |
| Comparative example 1-3 | 4 | 18 | 4.9 | 20.0 | 0.4 | 0.1 | 170 |
| Comparative example 2-1 | 5 | 18 | 6.4 | 25.0 | 0.4 | 0.1 | 250 |
| Comparative example 2-2 | 4 | 12 | 7.1 | 20.0 | 0.4 | 0.1 | 190 |
| Comparative example 3 | 4 | 18 | 4.9 | 20.0 | 0.4 | 0.1 | 170 |

3. Preparation of White Paste

Photopolymerizable monomer, photo-initiator, additive and inorganic component of $B_2O_3$—$SiO_2$—$Al_2O_3$ base glass powder and Ag powder were added to the organic medium as well as the preparation of the black paste described above. Content of the photopolymerizable monomer is shown in Table 3. 2-methyl-1-4-methylthiophenyl-2-morpho-lino-propanones as a photo-initiator was used with amount of 1.5 g per 100 g of white paste. The additives were 0.3 g of stabilizer and 0.05 g of surfactant per 100 g of the white paste.

Content and surface area of the glass powder and the silver powder per 100 g in the white paste were shown in Table 2 as well as total surface area (TSA) of the second inorganic powder. The TSA of the white paste is the total surface area of the second inorganic powder contained per 100 g of the white paste. The TSA of the white paste is the sum of the content weights (g) of the glass powder and silver powder per 100 g of the white paste multiplied by the SA values ($m^2/g$) of each.

The mixture was mixed well until the particles of the inorganic materials were wet with the organic medium. Then the mixture was dispersed using a 3-roll mill. The resulting white paste was filtered through a 20 μm square mesh filter.

The viscosity of the white paste at this point in time was about 15 Pascal second as measured, for example, at 10 rpm and 25° C.

TABLE 2

| | White paste | | | | TSA |
|---|---|---|---|---|---|
| | Ag powder | | Glass powder | | ($S_w$) |
| | SA ($m^2/g$) | weight (g) | SA ($m^2/g$) | weight (g) | ($m^2$) |
| Example 1-1 | 0.4 | 68 | 4.2 | 5.0 | 48 |
| Example 1-2 | 0.2 | 68 | 2.3 | 5.0 | 25 |
| Example 1-3 | 0.1 | 68 | 2.6 | 5.0 | 20 |
| Example 2-1 | 0.4 | 65 | 4.4 | 5.0 | 48 |
| Example 2-2 | 0.2 | 65 | 2.4 | 5.0 | 25 |
| Example 2-2 | 0.1 | 65 | 2.1 | 5.0 | 17 |
| Example 3-1 | 0.4 | 67 | 2.0 | 5.0 | 37 |
| Example 3-2 | 0.2 | 67 | 3.9 | 3.0 | 25 |
| Example 3-3 | 0.1 | 67 | 3.4 | 3.0 | 17 |
| Example 4-1 | 0.4 | 68 | 0.5 | 6.0 | 30 |
| Example 4-2 | 0.3 | 68 | 0.8 | 6.0 | 25 |
| Example 4-3 | 0.1 | 68 | 0.9 | 6.0 | 12 |
| Example 5-1 | 0.3 | 60 | 3.0 | 3.0 | 27 |
| Example 5-2 | 0.2 | 60 | 0.3 | 3.0 | 13 |
| Example 5-3 | 0.1 | 60 | 1.3 | 3.0 | 10 |
| Example 6-1 | 0.3 | 58 | 2.8 | 2.0 | 23 |
| Example 6-2 | 0.2 | 58 | 2.7 | 2.0 | 17 |
| Example 6-3 | 0.1 | 58 | 1.6 | 2.0 | 9 |

TABLE 2-continued

| | White paste | | | | TSA |
|---|---|---|---|---|---|
| | Ag powder | | Glass powder | | ($S_w$) |
| | SA ($m^2$/g) | weight (g) | SA ($m^2$/g) | weight (g) | ($m^2$) |
| Example 7-1 | 0.2 | 50 | 2.5 | 2.0 | 15 |
| Example 7-2 | 0.1 | 50 | 2.5 | 2.0 | 10 |
| Example 7-3 | 0.1 | 50 | 0.5 | 2.0 | 6 |
| Comparative example 1-1 | 0.6 | 70 | 9.3 | 3.0 | 70 |
| Comparative example 1-2 | 0.6 | 70 | 7.7 | 3.0 | 65 |
| Comparative example 1-3 | 0.6 | 70 | 2.7 | 3.0 | 50 |
| Comparative example 2-1 | 0.6 | 70 | 9.3 | 3.0 | 70 |
| Comparative example 2-2 | 0.6 | 70 | 7.7 | 3.0 | 65 |
| Comparative example 3 | 0.1 | 65 | 2.1 | 5.0 | 17 |

4. Preparation of Front Electrodes

Precautions were taken to avoid dirt contamination, by dirt during the preparation of the paste and the manufacture of the parts would have resulted in defects.

4-1. Formation of Black Layer

The black paste was applied onto a glass substrate (50 mm width, 75 mm length and 1.8 mm thickness) by screen printing using a 38 mesh screen. The printing pattern of the black paste layer was 40 mm square and 5 μm thickness. The paste was printed onto the glass substrate on which transparent electrodes had been formed. The printed black paste was then dried for 20 minutes at 100° C. in an air circulating furnace.

4-2. Formation of White Layer

The white paste was applied by screen printing on the printed black paste layer using a 40 mesh screen. The printing pattern of the white paste layer was 40 mm square same as the black paste layer. The thickness in average of the printed white paste was 9.5 μm. The printed white paste was dried for 20 minutes at 100° C. in an air circulating furnace.

4-3. UV Ray Pattern Exposure

The black and white double-layered structure was exposed to light from a collimated UV radiation source (illumination: 18-20 mW/$m^2$; exposure: 20 mj/$m^2$) through a photo mask which had line patterns. The line patterns were 10, 15, 20, 40, 60 μm width respectively and 40 mm length.

4-4. Development

The exposed double-layered structure was placed on a conveyor and then placed in a spray developing device which had 0.4 g sodium carbonate aqueous solution as a developer. The developer was kept at a temperature of 30° C., and was sprayed to the exposed double-layered structure at 10 to 20 psi for 15 seconds. After developing, exposed area of black paste and white paste remained. The developed double-layered structure was dried by blowing off the excess water with an air jet.

4-5. Sintering

The developed double-layered structure was sintered in a belt furnace. A peak temperature of 590° C. was reached (first sintering) by sintering in a belt furnace in air using a 1.5 hour profile. A front electrode was formed through the above steps.

5. Results

The resolution was given as the width of the finest line that could be developed without errors out of the formed 10, 15, 20, 40 and 60 μm-wide line patterns. The finer the line could be developed, the greater the resolution was. The results are shown in Table 3. In Examples 1 to 7 in which the ratio ($S_b/M_b$) of the total surface area of the first inorganic powder in the black paste ($S_b$) to the monomer content ($M_b$) was 12.5 or less, and the ratio ($S_w/M_w$) of the TSA of the second inorganic powder ($S_w$) to the monomer content ($M_w$) in the white paste was 4.5 or less, 20 μm-wide lines were developed without error. In Examples 6 in which $S_b/M_b$ was 7 and $S_w/M_w$ was 1.5, 15 μm-wide lines were developed without error, while in Example 7 in which $S_b/M_b$ was 6.5 and $S_w/M_w$ was 1.0, 10 μm-wide lines were developed without error.

TABLE 3

| | Black paste | | | White paste | | | Finest |
|---|---|---|---|---|---|---|---|
| | TSA ($S_b$) ($m^2$) | Monomer ($M_b$) (g) | $S_b/M_b$ | TSA ($S_w$) ($m^2$) | Monomer ($M_w$) (g) | $S_w/M_w$ | line width (um) |
| Example 1-1 | 165 | 13.2 | 12.5 | 48 | 13.7 | 3.5 | 20 |
| Example 1-2 | 124 | 9.9 | 12.5 | 25 | 7.1 | 3.5 | 20 |
| Example 1-3 | 90 | 7.2 | 12.5 | 20 | 5.7 | 3.5 | 20 |
| Example 2-1 | 165 | 18.3 | 9.0 | 48 | 16.0 | 3.0 | 20 |
| Example 2-2 | 124 | 13.8 | 9.0 | 25 | 8.3 | 3.0 | 20 |
| Example 2-2 | 90 | 10.0 | 9.0 | 17 | 5.7 | 3.0 | 20 |
| Example 3-1 | 165 | 19.4 | 8.5 | 37 | 14.8 | 2.5 | 20 |
| Example 3-2 | 124 | 14.6 | 8.5 | 25 | 10.0 | 2.5 | 20 |
| Example 3-3 | 90 | 10.6 | 8.5 | 17 | 6.8 | 2.5 | 20 |
| Example 4-1 | 165 | 20.6 | 8.0 | 30 | 15.0 | 2.0 | 20 |
| Example 4-2 | 124 | 15.5 | 8.0 | 25 | 12.5 | 2.0 | 20 |
| Example 4-3 | 90 | 11.3 | 8.0 | 12 | 6.0 | 2.0 | 20 |
| Example 5-1 | 165 | 22.0 | 7.5 | 27 | 15.0 | 1.8 | 20 |
| Example 5-2 | 124 | 16.5 | 7.5 | 13 | 7.2 | 1.8 | 20 |
| Example 5-3 | 90 | 12.0 | 7.5 | 10 | 5.6 | 1.8 | 20 |
| Example 6-1 | 165 | 23.6 | 7.0 | 23 | 15.3 | 1.5 | 15 |
| Example 6-2 | 124 | 17.7 | 7.0 | 17 | 11.3 | 1.5 | 15 |
| Example 6-3 | 90 | 12.9 | 7.0 | 9 | 6.0 | 1.5 | 15 |
| Example 7-1 | 160 | 24.6 | 6.5 | 15 | 15.0 | 1.0 | 10 |
| Example 7-2 | 124 | 19.1 | 6.5 | 10 | 10.0 | 1.0 | 10 |
| Example 7-3 | 90 | 13.9 | 6.5 | 6 | 6.0 | 1.0 | 10 |
| Comparative example 1-1 | 250 | 10.4 | 24.0 | 70 | 7.0 | 10.0 | 60 |
| Comparative example 1-2 | 190 | 7.9 | 24.0 | 65 | 6.5 | 10.0 | 60 |
| Comparative example 1-3 | 170 | 7.1 | 24.0 | 50 | 5.0 | 10.0 | 60 |
| Comparative example 2-1 | 250 | 12.5 | 20.0 | 70 | 14.0 | 5.0 | 40 |
| Comparative example 2-2 | 190 | 9.5 | 20.0 | 65 | 13.0 | 5.0 | 40 |
| Comparative example 3 | 170 | 7.1 | 24.0 | 17 | 5.7 | 3.0 | 40 |

We claim:

1. A method for forming a front electrode of PDP, comprising steps of:

applying, to a substrate, a black paste comprising a photopolymerizable monomer and first inorganic powder comprising glass powder, black pigment and optionally conductive metal powder, wherein $S_b/M_b$ is 18 or less when $S_b$ represents the total surface area ($m^2$) of the first inorganic powder per 100 g of the black paste and $M_b$ represents the content (g) of the photopolymerizable monomer per 100 g of the black paste;

drying the black paste;

applying a white paste comprising a photopolymerizable monomer and second inorganic powder comprising glass powder and conductive metal powder on top of the dried black paste, wherein $S_w/M_w$ is 4.5 or less when $S_w$ represents the total surface area ($m^2$) of the second inorganic powder per 100 g of the white paste and $M_w$ represents the content (g) of the photopolymerizable monomer per 100 g of the white paste;

drying the white paste;

exposing and developing the dried black paste and the white paste; and sintering the developed black paste and white paste.

2. The method for forming a front electrode of PDP of claim 1, wherein the total surface area ($S_b$) of the first inorganic powder per 100 g of the black paste is 50 to 200 $m^2$.

3. The method for forming a front electrode of PDP of claim 1, wherein the total surface area ($S_w$) of the second inorganic powder per 100 g of the white paste is 4.5 to 60 $m^2$.

4. The method for forming a front electrode of PDP of claim 1, wherein the content ($M_b$) of the photopolymerizable monomer per 100 g of the black paste is 6 to 30 g.

5. The method for forming a front electrode of PDP of claim 1, wherein the content ($M_w$) of the photopolymerizable monomer per 100 g of the white paste is 4 to 20 g.

6. A front electrode of PDP formed by the method of claim 1.

* * * * *